US010174664B2

(12) United States Patent
Toyama et al.

(10) Patent No.: US 10,174,664 B2
(45) Date of Patent: Jan. 8, 2019

(54) COOLING CONTROL APPARATUS FOR INTERNAL COMBUSTION ENGINE AND COOLING CONTROL METHOD THEREFOR

(71) Applicant: Hitachi Automotive Systems, Ltd., Hitachinaka-shi, Ibaraki (JP)

(72) Inventors: Yuichi Toyama, Isesaki (JP); Atsushi Murai, Isesaki (JP); Shigeyuki Sakaguchi, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/512,586

(22) PCT Filed: Nov. 10, 2015

(86) PCT No.: PCT/JP2015/081639
§ 371 (c)(1),
(2) Date: Mar. 20, 2017

(87) PCT Pub. No.: WO2016/076324
PCT Pub. Date: May 19, 2016

(65) Prior Publication Data

US 2017/0292435 A1 Oct. 12, 2017

(30) Foreign Application Priority Data

Nov. 12, 2014 (JP) ..... 2014-229530

(51) Int. Cl.
*F01P 7/04* (2006.01)
*F01P 7/16* (2006.01)
(Continued)

(52) U.S. Cl.
CPC ..... *F01P 7/026* (2013.01); *F01P 1/06* (2013.01); *F01P 3/20* (2013.01); *F01P 5/12* (2013.01);
(Continued)

(58) Field of Classification Search
CPC ..... F01P 7/026; F01P 7/04; F01P 3/20; F01P 5/12; F01P 11/16; F01P 7/164; F02D 41/042
See application file for complete search history.

(56) References Cited

U.S. PATENT DOCUMENTS

2011/0214627 A1 9/2011 Nishikawa et al.
2013/0180477 A1 7/2013 Nakajima et al.
(Continued)

FOREIGN PATENT DOCUMENTS

DE 34 24 580 C1 11/1985
DE 10 2009 023 724 A1 12/2010
(Continued)

OTHER PUBLICATIONS

International Preliminary Report on Patentability (PCT/IPEA/409) issued in PCT Application No. PCT/JP2015/081639 dated Oct. 31, 2016 with English translation (6 pages).
(Continued)

*Primary Examiner* — Jacob Amick
(74) *Attorney, Agent, or Firm* — Crowell & Moring LLP

(57) ABSTRACT

The present invention relates to a cooling control apparatus which performs control for cooling an internal combustion engine by causing an electric pump to circulate cooling water and causing an electric fan to supply cooling air to a radiator. The cooling control apparatus comprises an electric pump for circulating a coolant through a coolant passage formed in the internal combustion engine, and a radiator and a radiator fan which are for cooling the coolant. When the internal combustion engine stops after completion of warming-up, the radiator fan and the electric pump are driven to cool the internal combustion engine, and when a temperature of the coolant decreases to less than a temperature at a
(Continued)

time of engine stop, the radiator fan is stopped in a state in which the electric pump is operated.

16 Claims, 10 Drawing Sheets

(51) Int. Cl.

| | |
|---|---|
| ***F01P 7/02*** | (2006.01) |
| ***F01P 11/16*** | (2006.01) |
| ***F02D 41/04*** | (2006.01) |
| ***F01P 1/06*** | (2006.01) |
| ***F01P 3/20*** | (2006.01) |
| ***F01P 5/12*** | (2006.01) |
| *F02D 29/02* | (2006.01) |
| *F02N 11/08* | (2006.01) |
| *F02M 26/28* | (2016.01) |
| *F02M 26/73* | (2016.01) |

(52) U.S. Cl.
CPC ..... *F01P 7/04* (2013.01); *F01P 7/164* (2013.01); *F01P 11/16* (2013.01); *F02D 41/042* (2013.01); *F01P 2005/125* (2013.01); *F01P 2031/30* (2013.01); *F02D 29/02* (2013.01); *F02M 26/28* (2016.02); *F02M 26/73* (2016.02); *F02N 11/0814* (2013.01)

(56) References Cited

U.S. PATENT DOCUMENTS

| | | | |
|---|---|---|---|
| 2013/0284127 | A1 | 10/2013 | Goto et al. |
| 2013/0298851 | A1 | 11/2013 | Nishikawa et al. |

FOREIGN PATENT DOCUMENTS

| | | | |
|---|---|---|---|
| DE | 10 2011 004 998 | A1 | 9/2011 |
| DE | 11 2011 104 420 | T5 | 9/2013 |
| EP | 2 639 424 | A1 | 9/2013 |
| JP | 2011-179460 | A | 9/2011 |
| JP | 2012-102621 | A | 5/2012 |
| JP | 2012-127262 | A | 7/2012 |
| JP | 2012-197706 | A | 10/2012 |
| JP | 2013-19297 | A | 1/2013 |
| JP | 2013-44281 | A | 3/2013 |

OTHER PUBLICATIONS

English translation of Japanese-language International Preliminary Report on Patentability (PCT/IB/338 & PCT/IPEA/409) issued in PCT Application No. PCT/JP2015/081639 dated May 18, 2017, previously filed on Mar. 21, 2017 (6 pages).
International Search Report (PCT/ISA/210) issued in PCT Application No. PCT/JP2015/081639 dated Feb. 16, 2016 with English translation (5 pages).
Japanese-language Written Opinion (PCT/ISA/237) issued in PCT Application No. PCT/JP2015/081639 dated Feb. 16, 2016 (4 pages).
German-language Office Action issued in counterpart German Application No. 11 2015 005 126.0 dated Jun. 15, 2018 with partial English translation (thirteen (13) pages).

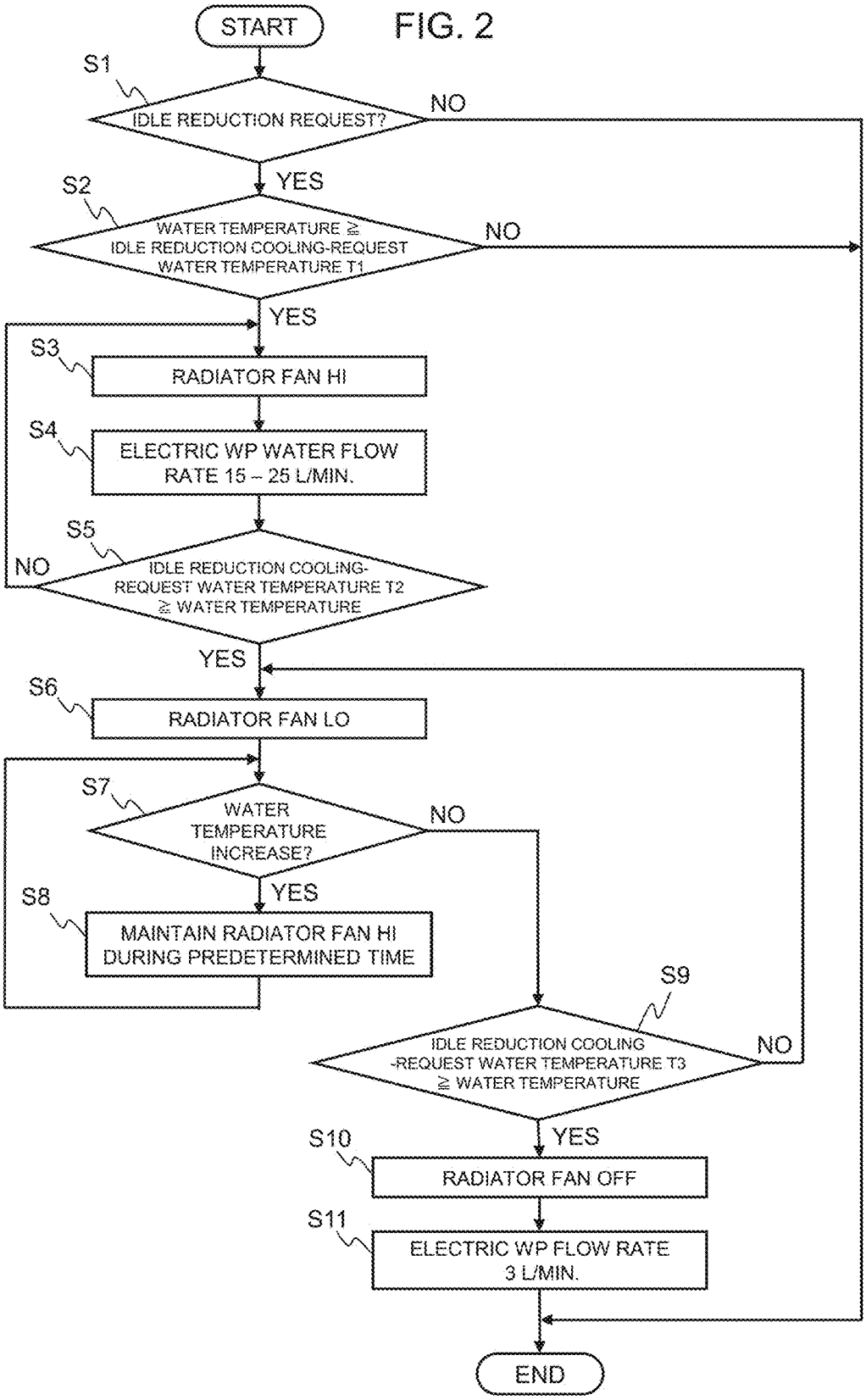
FIG. 2
START
S1
IDLE REDUCTION REQUEST?
NO
YES
S2
WATER TEMPERATURE ≧ IDLE REDUCTION COOLING-REQUEST WATER TEMPERATURE T1
NO
YES
S3
RADIATOR FAN HI
S4
ELECTRIC WP WATER FLOW RATE 15 – 25 L/MIN.
S5
IDLE REDUCTION COOLING-REQUEST WATER TEMPERATURE T2 ≧ WATER TEMPERATURE
NO
YES
S6
RADIATOR FAN LO
S7
WATER TEMPERATURE INCREASE?
NO
YES
S8
MAINTAIN RADIATOR FAN HI DURING PREDETERMINED TIME
S9
IDLE REDUCTION COOLING -REQUEST WATER TEMPERATURE T3 ≧ WATER TEMPERATURE
NO
YES
S10
RADIATOR FAN OFF
S11
ELECTRIC WP FLOW RATE 3 L/MIN.
END

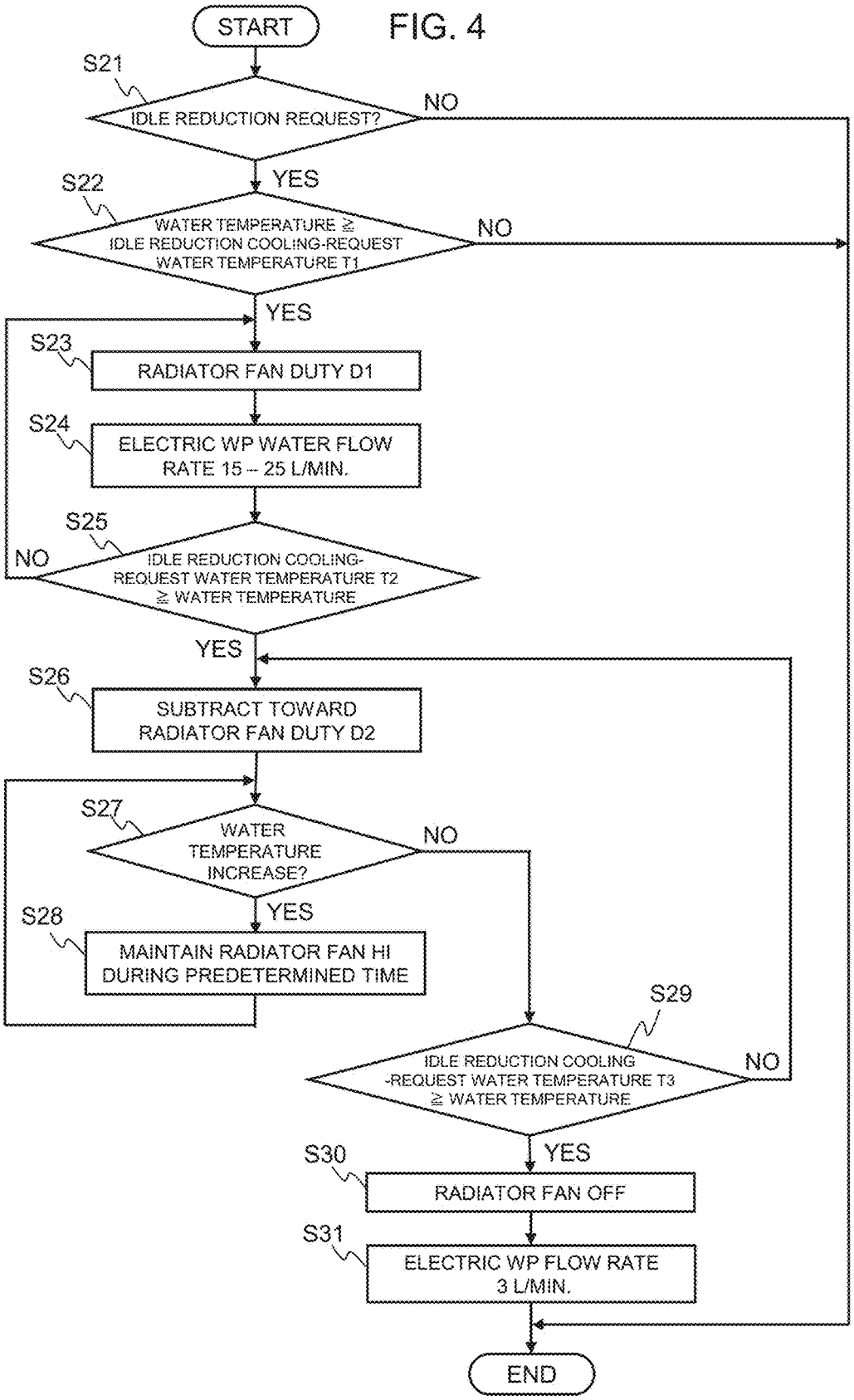
FIG. 4
START
S21
IDLE REDUCTION REQUEST?
NO
YES
S22
WATER TEMPERATURE ≧ IDLE REDUCTION COOLING-REQUEST WATER TEMPERATURE T1
NO
YES
S23
RADIATOR FAN DUTY D1
S24
ELECTRIC WP WATER FLOW RATE 15 – 25 L/MIN.
S25
IDLE REDUCTION COOLING-REQUEST WATER TEMPERATURE T2 ≧ WATER TEMPERATURE
NO
YES
S26
SUBTRACT TOWARD RADIATOR FAN DUTY D2
S27
WATER TEMPERATURE INCREASE?
NO
YES
S28
MAINTAIN RADIATOR FAN HI DURING PREDETERMINED TIME
S29
IDLE REDUCTION COOLING -REQUEST WATER TEMPERATURE T3 ≧ WATER TEMPERATURE
NO
YES
S30
RADIATOR FAN OFF
S31
ELECTRIC WP FLOW RATE 3 L/MIN.
END

COOLING CONTROL APPARATUS FOR INTERNAL COMBUSTION ENGINE AND COOLING CONTROL METHOD THEREFOR

TECHNICAL FIELD

The present invention relates to a cooling control apparatus which perform control for cooling an internal combustion engine by causing an electric pump to circulate cooling water and causing an electric fan to supply cooling air to a radiator, and relates to a cooling control method therefor.

BACKGROUND ART

A cooling performance of an internal combustion engine (engine) is influenced by outside air temperature. Thus, in Patent Document 1, an electric pump and an electric fan are controlled taking into account variations in outside temperature, as well as a cooling water temperature and a battery voltage after the engine stops. According to Patent Document 1, the electric pump and the electric fan are driven when an ignition switch is turned off, and the electric fan is stopped after the electric pump is stopped.

REFERENCE DOCUMENT LIST

Patent Document

Patent Document 1: Japanese Patent Application Laid-open Publication No. 2012-127262

SUMMARY OF THE INVENTION

Problems to be Solved by the Invention

However, the technology of Patent Document 1 above does not consider a measurement error of a water temperature sensor at restart from an idle reduction state and a measurement delay of the water temperature sensor with respect to temperature change. Therefore, in terms of achieving both improvement of cooling effect and reduction of power consumption, there is still room for improvement. Specifically, without the flowing of the cooling water, the water temperature sensor cannot measure the exact water temperature due to variations in temperature within a piping or the like. Therefore, when the electric pump is stopped while the engine stops, measurement error increases when the electric pump is restarted. The time constant for temperature change at a cylinder head part is about three times greater than that of a temperature sensed by the water temperature sensor. Thus, the measurement response of the water temperature sensor is delayed with respect to a decrease of temperature due to engine stop. As a result, when the engine is restarted, the ignition timing is corrected to be excessively retarded for knock avoidance. This leads to reduction of torque and loss of fuel economy.

The present invention has been developed in view of the aforementioned circumstances, and an object thereof is to provide a cooling control apparatus for internal combustion engines which can reduce power consumption while improving a cooling effect, and to provide a cooling control method therefor.

Means for Solving the Problems

Accordingly, a cooling control apparatus for an internal combustion engine of the present invention comprises an electric pump for circulating a coolant through a coolant passage formed in the internal combustion engine, and a radiator and a radiator fan which are for cooling the coolant, wherein after completion of warming-up the internal combustion engine, when an automatic stop request is made for automatically stopping operation of the internal combustion engine with decrease in speed of a vehicle, if a temperature of the coolant is higher than or equal to a first cooling request temperature at the automatic stop, the radiator fan is driven at high speed, and the coolant is discharged for cooling from the electric pump at a first predetermined flow rate that is requested at the automatic stop of the internal combustion engine, when the temperature of the coolant decreases to a second cooling request temperature that is less than the first cooling request temperature, the radiator fan is switched to a low-speed drive, and when the temperature of the coolant decreases to a third cooling request temperature that is less than the second cooling request temperature and less than a temperature at the automatic stop, the radiator fan is stopped, and the coolant is discharged for cooling from the electric pump at a second predetermined flow rate which is less than a flow rate required for an automatic stop operation of the internal combustion engine.

Furthermore, a cooling control method for an internal combustion engine of the present invention is a cooling control method for an internal combustion engine including an electric pump for circulating a coolant through a coolant passage formed in the internal combustion engine, and a radiator and a radiator fan which are for cooling the coolant, the method comprising: after completion of warming-up the internal combustion engine, when an automatic stop request is made for automatically stopping operation of the internal combustion engine with decrease in speed of a vehicle, if a temperature of the coolant is higher than or equal to a first cooling request temperature at the automatic stop, driving the radiator fan at high speed, and discharging the coolant for cooling from the electric pump at a first predetermined flow rate that is requested at the automatic stop of the internal combustion engine; when the temperature of the coolant decreases to a second cooling request temperature that is less than the first cooling request temperature, switching the radiator fan to a low-speed drive; and when the temperature of the coolant decreases to a third cooling request temperature that is less than the second cooling request temperature and less than a temperature at the automatic stop, stopping the radiator fan, and discharging the coolant for cooling from the electric pump at a second predetermined flow rate which is less than a flow rate required for an automatic stop operation of the internal combustion engine.

Effects of the Invention

According to the present invention, cooling effect can be improved by driving a radiator fan and an electric pump when an internal combustion engine is stopped after warming-up. Furthermore, when the coolant decreases to less than a temperature when the engine stops, the radiator fan, which consumes large amounts of power, is stopped while circulating a coolant by the electric pump, which consumes small amounts of power, whereby power consumption can be reduced. Continuous operation of the electric pump enables suppressing reduction in accuracy of temperature measurement of the water temperature sensor, and continuous circulation of the cooling water enables suppressing influence of difference in time constant of temperature change. This prevents excessive correction of ignition timing at the time of engine restart, so that reduction of torque and loss of fuel economy can be suppressed.

BRIEF DESCRIPTION OF THE DRAWINGS

FIG. 2 is a flowchart illustrating a first control operation of a water pump and a radiator fan at an idle reduction state by the cooling control apparatus illustrated in FIG. 1.

FIG. 4 is a flowchart illustrating a second control operation of the water pump and the radiator fan at the idle reduction state by the cooling control apparatus illustrated in FIG. 1.

MODE FOR CARRYING OUT THE INVENTION

Figure 1:
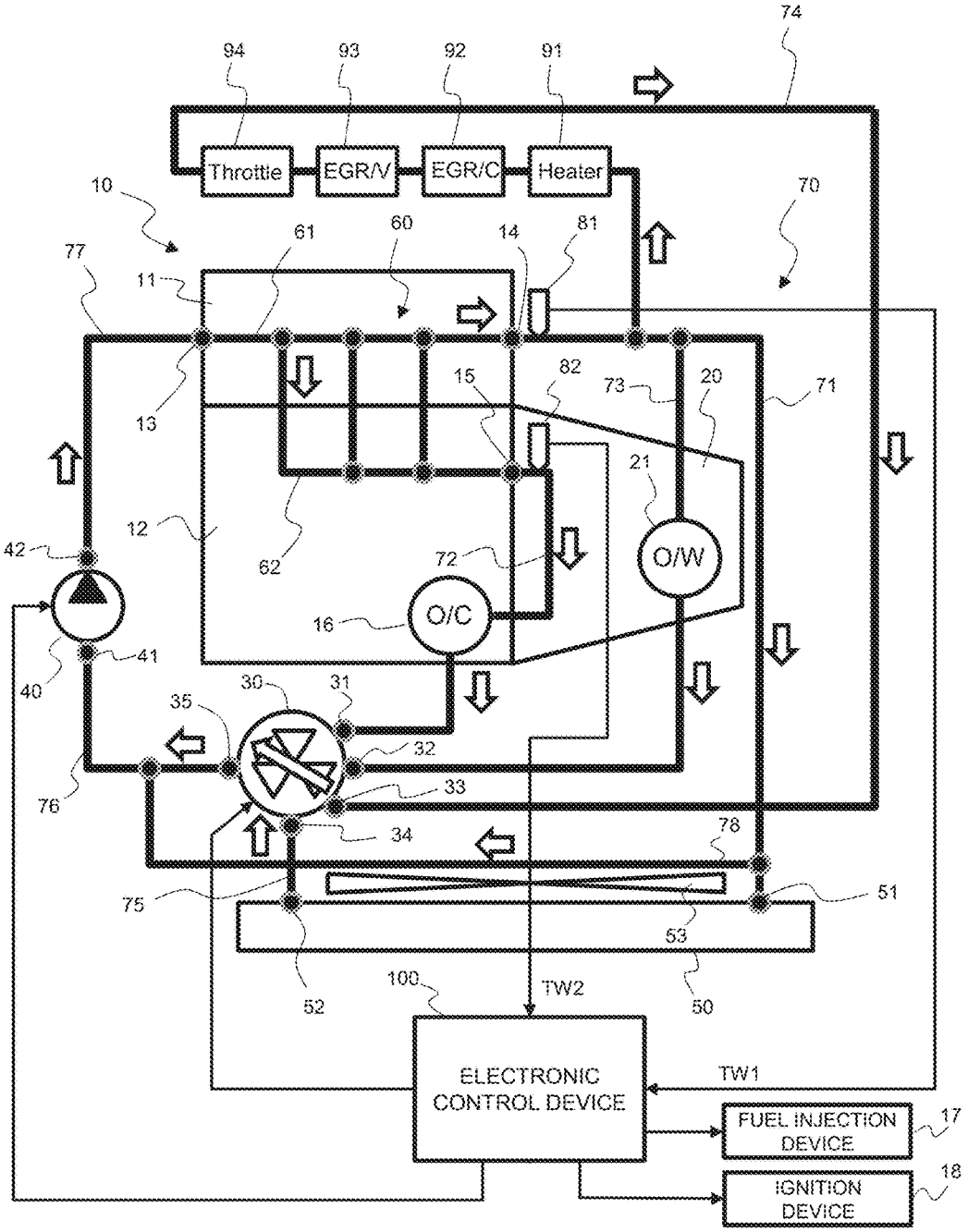
FIG. 1 is a schematic configuration diagram of a cooling control apparatus for an internal combustion engine according to an embodiment of the present invention.

In the following, an embodiment of the present invention will be described with reference to the accompanying drawings. FIG. 1 illustrates a configuration example of a cooling control apparatus for an internal combustion engine according to the embodiment of the present invention. A vehicle engine (internal combustion engine) 10 includes a cylinder head 11 and a cylinder block 12. A transmission 20 as an example of a power transmission device is connected with the output shaft of engine 10, so that an output of transmission 20 is transmitted to driving wheels (not illustrated). The cooling device of engine 10, which is a water cooling type cooling device for circulating cooling water (coolant), comprises a flow control valve 30 which is operated by an electric actuator, an electric water pump (electric pump) 40 which is operated by an electric motor, a radiator 50, a radiator fan 53, a cooling water passage (coolant passage) 60 provided in engine 10, and a piping 70 for connecting these components.

Engine 10 is provided with a head-side cooling water passage 61 as a part of cooling water passage 60. Head-side cooling water passage 61 extends in cylinder head 11 and connects a cooling water inlet 13 and a cooling water outlet 14. Cooling water inlet 13 is formed at one end in the cylinder arrangement direction of cylinder head 11, and cooling water outlet 14 is formed at the other end in the cylinder arrangement direction of cylinder head 11. Engine 10 is also provided with a block-side cooling water passage 62 as another part of cooling water passage 60. Block-side cooling water passage 62 is branched from head-side cooling water passage 61 to cylinder block 12. Block-side cooling water passage 62 is extended in cylinder block 12, and is connected with a cooling water outlet 15 provided in cylinder block 12. Cooling water outlet 15 of cylinder block 12 is provided at the end in the cylinder arrangement direction on the same side on which cooling water outlet 14 is provided.

In this way, cooling water is supplied to cylinder block 12 via cylinder head 11. The cooling water only passing through cylinder head 11 is discharged from cooling water outlet 14, whereas the cooling water, flowing into cylinder head 11 and subsequently passing through cylinder block 12, is discharged from cooling water outlet 15. A first cooling water piping 71 is connected with cooling water outlet 14 of cylinder head 11 at one end, and is connected with a cooling water inlet 51 of radiator 50 at the other end.

A second cooling water piping 72 is connected with cooling water outlet 15 of cylinder head 12 at one end, and is connected with a first inlet port 31 among four inlet ports 31 to 34 (flow-in side) of flow control valve 30 at the other end. In the midway of second cooling water piping 72, an oil cooler (O/C) 16 for cooling a lubricant for engine 10 is provided. Oil cooler 16 exchanges heat between the cooling water flowing through second cooling water piping 72 and the lubricant for engine 10.

A third cooling water piping 73 is connected with first cooling water piping 71 at one end, and is connected to a second inlet port 32 of flow control valve 30 at the other end. In the midway of third cooling water piping 73, an oil warmer (O/W) 21 for heating an operating oil for transmission 20 is provided. Oil warmer 21 exchanges heat between the cooling water flowing through third cooling water piping 73 and the operating oil for transmission 20. In other words, the cooling water passing through cylinder head 11 is branched and guided to water cooling type oil warmer 21, and the operating oil is heated at oil warmer 21.

A fourth cooling water piping 74 is connected with first cooling water piping 71 at one end, and is connected with a third inlet port 33 of flow control valve 30 at the other end. Various heat exchanging devices are provided along fourth cooling water piping 74.

As the heat exchanging devices mentioned above, a heater core (Heater) 91 for vehicle heating, a water cooling type EGR cooler (EGR/C) 92 which constitutes the exhaust recirculation device of engine 10, an exhaust recirculation control valve (EGR/V) 93, which similarly constitutes the exhaust recirculation device, for controlling an exhaust gas recirculation flow rate, and a throttle valve (Throttle) 94 for controlling an intake air amount of engine 10, are provided and arranged in this order from the upstream side. Heater core 91 is a device for exchanging heat between the cooling water in fourth cooling water piping 74 and the conditioned air, so as to heat the conditioned air.

EGR cooler 92 is a device for exchanging heat between the exhaust gas to be recirculated by the exhaust recirculation device to the intake system of engine 10 and the cooling water in fourth cooling water piping 74, so as to decrease the temperature of the exhaust gas to be recirculated. Furthermore, exhaust recirculation control valve 93 and throttle valve 94 are configured to be heated by heat exchange with the cooling water in fourth cooling water piping 74. This suppresses freezing of a water content in exhaust gas or intake air near exhaust recirculation control valve 93 and throttle valve 94.

In this way, the cooling water passed through cylinder head 11 is branched and guided through heater core 91, EGR cooler 92, exhaust recirculation control valve 93, and throttle valve 94, for exchanging heat therewith. A fifth cooling water piping 75 is connected with a cooling water outlet 52 of radiator 50 at one end, and is connected with fourth inlet port 34 of flow control valve 30 at the other end.

Flow control valve 30 has one outlet port 35. A sixth cooling water piping 76 is connected with the outlet port 35 at one end, and is connected with an intake port 41 of water pump 40 at the other end. Furthermore, a seventh cooling water piping 77 is connected with a discharge port 42 of water pump 40 at one end, and is connected with a cooling water inlet 13 of cylinder head 11 at the other end.

Furthermore, an eighth cooling water piping 78 is provided. One end of eighth cooling water piping 78 is connected with first cooling water piping 71 at a position downstream the positions at which third cooling water piping 73 and fourth cooling water piping 74 are connected, and the other end thereof is connected with sixth cooling water piping 76. As described above, flow control valve 30 has four inlet ports 31 to 34 with which cooling water pipings 72, 73, 74, 75 are respectively connected, and one outlet port 35 with which sixth cooling water piping 76 is connected.

Flow control valve 30 is, for example, a rotary flow-passage switching valve having a rotor including a flow passage, and a stator in which a plurality of ports 31 to 35 are formed. It is configured such that the stator is fitted over the rotor in a manner in which the respective ports of the stator are connected by changing the angular position of the rotor by rotating the rotor by an electric actuator such as an electric motor. For such rotary flow control valve 30, the opening area ratios of four inlet port 31 to 34 change according to the rotor angle. The flow passage of the rotor is adapted such that the opening area ratio (flow rate ratio) can be controlled as desired by selecting a rotor angle.

In the configuration described above, head-side cooling water passage 61 and first cooling water piping 71 provide a first coolant line which passes through cylinder head 11 and radiator 50, and block-side cooling water passage 62 and second cooling water piping 72 provide a second coolant line which passes through cylinder block 12 while bypassing radiator 50. Furthermore, head-side cooling water passage 61 and fourth cooling water piping 74 provide a third coolant line which passes through cylinder head 11 and heater core 91 while bypassing radiator 50. Head-side cooling water passage 61 and third cooling water piping 73 provide a fourth coolant line which passes through cylinder head 11 and oil warmer 21 of transmission 20 while bypassing radiator 50.

Furthermore, eighth cooling water piping 78 provides a bypass line, which is branched from the first coolant line between cylinder head 11 and radiator 50 and which is merged at a portion on the flow out side of flow control valve 30 bypassing radiator 50. In other words, flow control valve 30 is connected with the first coolant line, the second coolant line, the third coolant line, and the fourth coolant line on the flow-in side. The flow-out side of flow control valve 30 is connected to the flow-in side of the water pump 40. Flow control valve 30 is a flow passage switching mechanism. A supply amount (distribution ratio) of cooling water to the first, second, third, fourth coolant lines is controlled by adjusting the opening area of each outlet of the coolant lines.

Flow control valve 30 has a plurality of flow passage switching patterns, and it is configured such that the flow passage switching patterns are switched from one to another by changing a rotor angle by electric actuator. Specifically, flow control valve 30 closes all inlet ports 31 to 34 within a range from a reference angular position to a predetermined angle, in which the rotor angle is limited by a stopper. The state in which all inlet ports 31 to 34 are closed includes a state in which the opening area of each inlet port 31 to 34 is zero and a minimum opening area greater than zero (a state in which a leakage flow occurs).

When the rotor angle is increased beyond the angle at which all inlet ports 31 to 34 are closed, third inlet port 33, to which outlet of the heater core coolant line is connected, is opened to a specific opening, and subsequently, the aforementioned specific flow rate is maintained against an increase of the rotor angle. When a rotor angle is further increased from the angle at which third inlet port 33 opened to the specific opening, first inlet port 31, to which the outlet of the block coolant line is connected, starts opening, and the opening area of first inlet port 31 gradually increases in response to an increase of the rotor angle.

At an angular position which is greater than the angle at which first inlet port 31 starts being opened, second inlet port 32, to which the outlet of the heater core coolant line is connected, is opened to a specified opening, and subsequently, the specific opening is maintained against an increase of the rotor angle. Furthermore, at an angular position greater than the angle at which second inlet port 32 is opened to the specific opening, fourth inlet port 34, to which the outlet of a radiator coolant line is connected, starts opening, and the opening area of fourth inlet port 34 gradually increases in response to an increase of the rotor angle.

A water temperature sensor (first temperature sensor) 81, for measuring a temperature of cooling water within first cooling water piping 71, i.e., a temperature of cooling water near the outlet of cylinder head 11, is provided in the vicinity of cooling water outlet 14. A water temperature measurement signal TW1 from water temperature sensor 81 is input to an electronic control device (controller, control unit) 100. Then, electronic control device 100 outputs operation signals to water pump 40 and flow control valve 30 to control the discharge amount of water pump 40 and a flow rate ratio provided by flow control valve 30. The temperature sensor may only be water temperature sensor 81 which measures a temperature of cooling water near the outlet of cylinder head 11. In this embodiment, another water temperature sensor (second temperature sensor) 82 for measuring cooling water temperature within second cooling water piping 72 in the vicinity of cooling water outlet 15 is also provided. A water temperature measurement signal TW2 from water temperature sensor 82 is input to electronic control device 100, which in turn controls the discharge amount of water pump 40 and the flow rate ratio provided by flow control valve 30 taking into consideration water temperature measurement signal TW2 in addition to water temperature measurement signal TW1. As described above, when water temperature sensor 82 for measuring the temperature of cooling water is near the outlet of cylinder block 12, temperature control of cylinder block 12 becomes possible and friction in engine 10 is reduced, whereby fuel economy can be improved.

Furthermore, electronic control device 100 has a function of controlling a fuel injection device 17 and an ignition device 18 of engine 10, and a function of controlling the idle reduction state at which engine 10 is temporarily stopped, for example, when a vehicle comes to a halt and waits for a traffic signal to change. It is possible to provide an electronic control device having a function of controlling engine 10 apart from electronic control device 100, and to configure so that mutual communication is made between the electronic control device for engine control and electronic control device 100 which is provided for a cooling system and which controls water pump 40 and flow control valve 30.

Furthermore, electronic control device 100 has a function of sequentially switching the rotor angle (flow passage switching pattern) of flow control valve 30 as the warm-up of engine 10 proceeds, and has a function for changing a discharge amount of water pump 40 and a cooling air by radiator fan 53. It controls a temperature of cylinder head 11 and a temperature of cylinder block 12 to their respective target temperatures.

Next, control of water pump 40 and radiator fan 53 by electronic control device 100 will be described in detail. FIG. 2 illustrate a first control operation at the idle reduction state. First, it is determined whether there is an idle reduction request (step S1). If there is an idle reduction request, then, it is determined whether or not the cooling water temperature (water temperature) measured by the water temperature sensor is higher than or equal to an idle reduction cooling request water temperature T1 (step S2). For the water temperature sensor, first water temperature sensor 81 for measuring the temperature of cooling water with large temperature variation near the outlet of cylinder head 11 may be used. In addition to first temperature sensor 81, a temperature measured by second temperature sensor 82 for measuring the temperature of cooling water near the outlet of cylinder block 12 may be taken into account. The following description will be made under the assumption that both temperature sensors 81 and 82 are used. If there is no idle reduction request, the processing flow terminates, and a cooling operation is performed according to an operation scene or conditions of engine 10.

In step S2, if it is determined that the cooling water temperature measured by temperature sensor 81, 82 is higher than or equal to idle reduction cooling request water temperature T1, radiator fan 53 is driven at high speed (HI) (step S3). Furthermore, electric water pump (WP) 40 is driven such that it discharges cooling water at a flow rate of 15 to 25 L/min (first predetermined flow rate) that is less than a discharge amount required for idling the internal combustion engine (step S4). However, if it is determined that the cooling water temperature measured by temperature sensor 81, 82 is lower than idle reduction cooling request water temperature T1, the processing flow terminates because cooling is not necessary.

In step S5, it is determined whether or not the water temperature is lower than idle reduction cooling request water temperature T2 (T2<T1) (step S5). If it is determined to be lower, radiator fan 53 is switched to low speed (LO) drive (step S6). If it is determined to be higher or equal, the processing flow returns to step S3, and radiator fan 53 is driven at high speed, and water pump 40 is driven to discharge the cooling water at a flow rate of 15 to 25 L/min for cooling.

In the next step, step S7, it is determined whether the water temperature increases. If it is determined that the water temperature increases, radiator fan 53 is driven at high speed for a predetermined time period (step S8). In step S7, if it is determined that the water temperature does not increase, then, it is determined whether the water temperature is lower than idle reduction cooling request water temperature T3 (T3<T2) (step S9). If it is determined to be higher or equal, radiator fan 53 is stopped (OFF) (step S10), and water pump 40 is driven to discharge the cooling water at flow rate of 3 L/min (second predetermined flow rate) for cooling (step S11). At this time, the discharge amount of water pump 40 is set to be greater than the minimum dischargeable flow rate. In step S9, if it is determined that the water temperature is less than idle reduction cooling request water temperature T3, the processing flow returns to step S6, and steps S6 through S9 are repeated.

Figure 3:
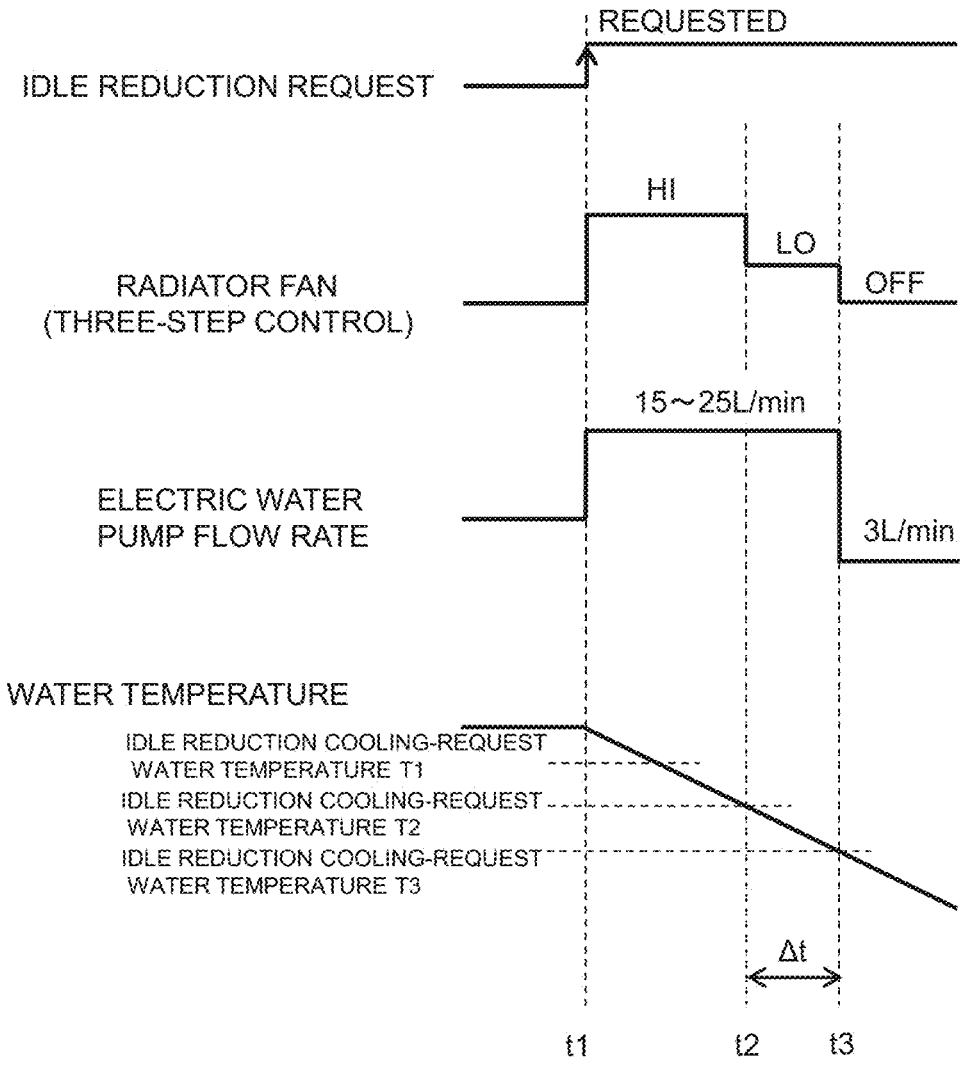
FIG. 3 is a timing chart of respective signals in the first control operation.

In the first control operation mentioned above, as illustrated in the timing chart in FIG. 3, the idle reduction request is made by electronic control device 100 at time t1. If the water temperature at this time is higher than idle reduction cooling request water temperature T1, radiator fan 53 is driven at high speed, and water pump 40 is driven to discharge the cooling water at a flow rate of 15 to 25 L/min. At time t2, when the water temperature decreases to less than idle reduction cooling request water temperature T2, radiator fan 53 is switched to a low speed drive. At time t3, when the water temperature decreases to less than idle reduction cooling request water temperature T3, radiator fan 53 is stopped (OFF) and water pump 40 is switched to a drive for discharging the cooling water at a flow rate of 3 L/min. When the water temperature increases between time t2 and time t3 (Δt), radiator fan 53 is switched to a high speed drive for a predetermined time period.

According to the first control operation described above, when the cooling water (coolant) decreases to idle reduction cooling request water temperature T3 which is less than a temperature at the idle reduction state (engine is stopped), radiator fan 53, which consumes large amounts of power, is stopped, while water pump 40, which consumes small amounts of power, to circulate the cooling water (coolant), is activated, whereby power consumption can be reduced while improving cooling effect. Furthermore, when the engine (internal combustion engine) is placed in the idle reduction state (engine is stopped) after completion of warming-up, water pump 40 is continuously driven to discharge the cooling water at a low flow rate, whereby reduction in measurement accuracy of the water temperature sensor due to variations in temperature within the piping can be prevented while suppressing a temperature increase of cooling water caused by residual heat. This prevents excessive correction of ignition timing at the time of engine restart, so that reduction of torque and loss of fuel economy can be minimized.

Furthermore, an early stop of the radiator fan during the idle reduction state enhances the quiet performance. In addition, pre-ignition at a restart at high water temperature can also be suppressed. In the first control operation above, an example in which the radiator fan is controlled among three steps was described. However, the number of levels to be switched may of course be increased to allow for finer control.

FIG. 4 illustrates a second control operation for water pump 40 and radiator fan 53 in the idle reduction state. First, it is determined whether there is an idle reduction request (step S21). If there is the idle reduction request, it is determined whether or not the cooling water temperature measured by water temperature sensor 81, 82 is higher than or equal to the idle reduction cooling request water temperature (step S22) T1. If there is no idle reduction request, the processing flow terminates, and a cooling operation is performed according to an operation scene or conditions of engine 10.

In step S22, if it is determined that the cooling water temperature measured by temperature sensor 81, 82 is higher than or equal to idle reduction cooling request water temperature T1, radiator fan 53 is driven at duty D1 (step S23). For driving radiator fan 53 at high speed, duty D1 is set high. Furthermore, water pump 40 is driven to discharge the cooling water at a flow rate of 15 to 25 L/min (step S24). However, if it is determined that the cooling water temperature measured by temperature sensor 81, 82 is lower than idle reduction cooling request water temperature T1, the processing flow terminates because cooling is not necessary.

In step S25, it is determined whether or not the water temperature is lower than idle reduction cooling request water temperature T2 (T2<T1) (step S25). If it is determined to be lower, radiator fan 53 is decelerated to duty D2 (step S26). If it is determined to be higher or equal, the processing flow returns to step S23, and radiator fan 53 is driven at duty D1, and water pump 40 is driven to discharge the cooling water at a flow rate of 15 to 25 L/min for cooling.

In the next step, step S27, it is determined whether the water temperature increases. If it is determined that the water temperature increases, the radiator fan is driven at high speed for a predetermined time period (step S28). In step S27, if it is determined that the water temperature does not increase, then, it is determined whether the water temperature is lower than idle reduction cooling request water temperature T3 (T3<T2) (step S29). If it is determined to be higher or equal, radiator fan 53 is stopped (step S30), and water pump 40 is driven to discharge the cooling water at a flow rate of 3 L/min for cooling (step S31). If it is determined that the water temperature is less than idle reduction cooling request water temperature T3 in step S29, the processing flow returns to step S26, and steps S26 through S29 are repeated.

Figure 5:
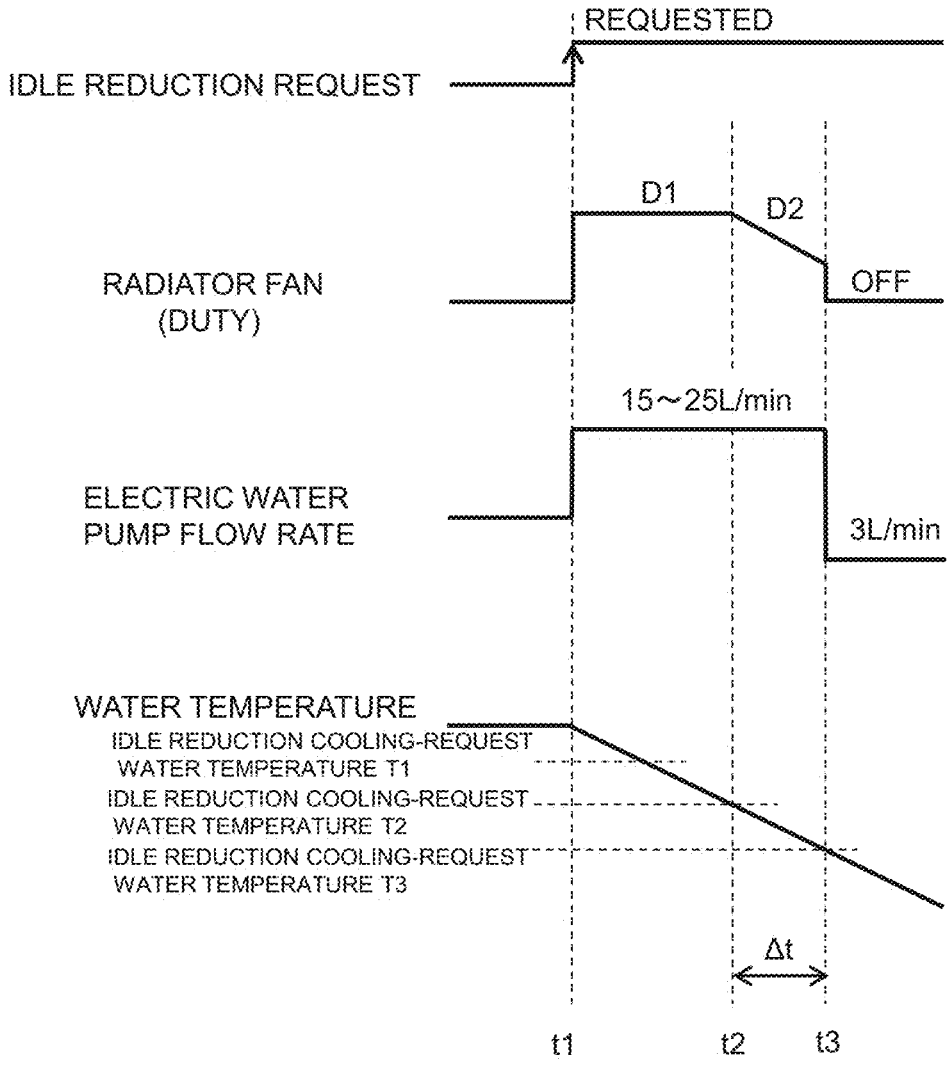
FIG. 5 is a timing chart of respective signals in the second control operation.

In the second control operation mentioned above, as illustrated in the timing chart in FIG. 5, the idle reduction request is made by electronic control device 100 at time t1. If the water temperature at this time is higher than idle reduction cooling request water temperature T1, radiator fan 53 is driven at first duty D1, and water pump 40 is driven to discharge the cooling water at a flow rate of 15 to 25 L/min. At time t2, when the water temperature decreases to less than idle reduction cooling request water temperature T2, the duty of the signal for driving radiator fan 53 is switched to second duty D2. At time t3, when the water temperature decreases to less than idle reduction cooling request water temperature T3, radiator fan 53 is stopped, and water pump 40 is switched to a drive for discharging cooling water at a flow rate of 3 L/min. When the water temperature increases between time t2 and time t3 (Δt), duty D2 of the signal for driving radiator fan 53 is increased during a predetermined time period.

By the second control operation described above, the same effect as that of the first control operation can be achieved. In other words, when the coolant decreases to idle reduction cooling request water temperature T3 that is less than a temperature at the idle reduction state, radiator fan 53 that consumes large amounts of power is stopped while circulating a coolant by electric water pump 40 that consumes low amounts of power, whereby power consumption can be reduced while improving cooling effect.

Furthermore, when the engine is placed in the idle reduction state after completion of warming-up, water pump 40 is continuously driven to discharge the cooling water at a low flow rate, whereby reduction in measurement accuracy of the water temperature sensor due to variations in temperature within the piping can be prevented while suppressing a temperature increase of cooling water caused by residual heat. This prevents excessive correction of ignition timing at the time of engine restart, so that reduction of torque and loss of fuel economy can be suppressed. Furthermore, an early stop of the radiator fan during the idle reduction state enhances the quiet performance. In addition, pre-ignition at a restart at high water temperature can also be suppressed.

Figure 6:
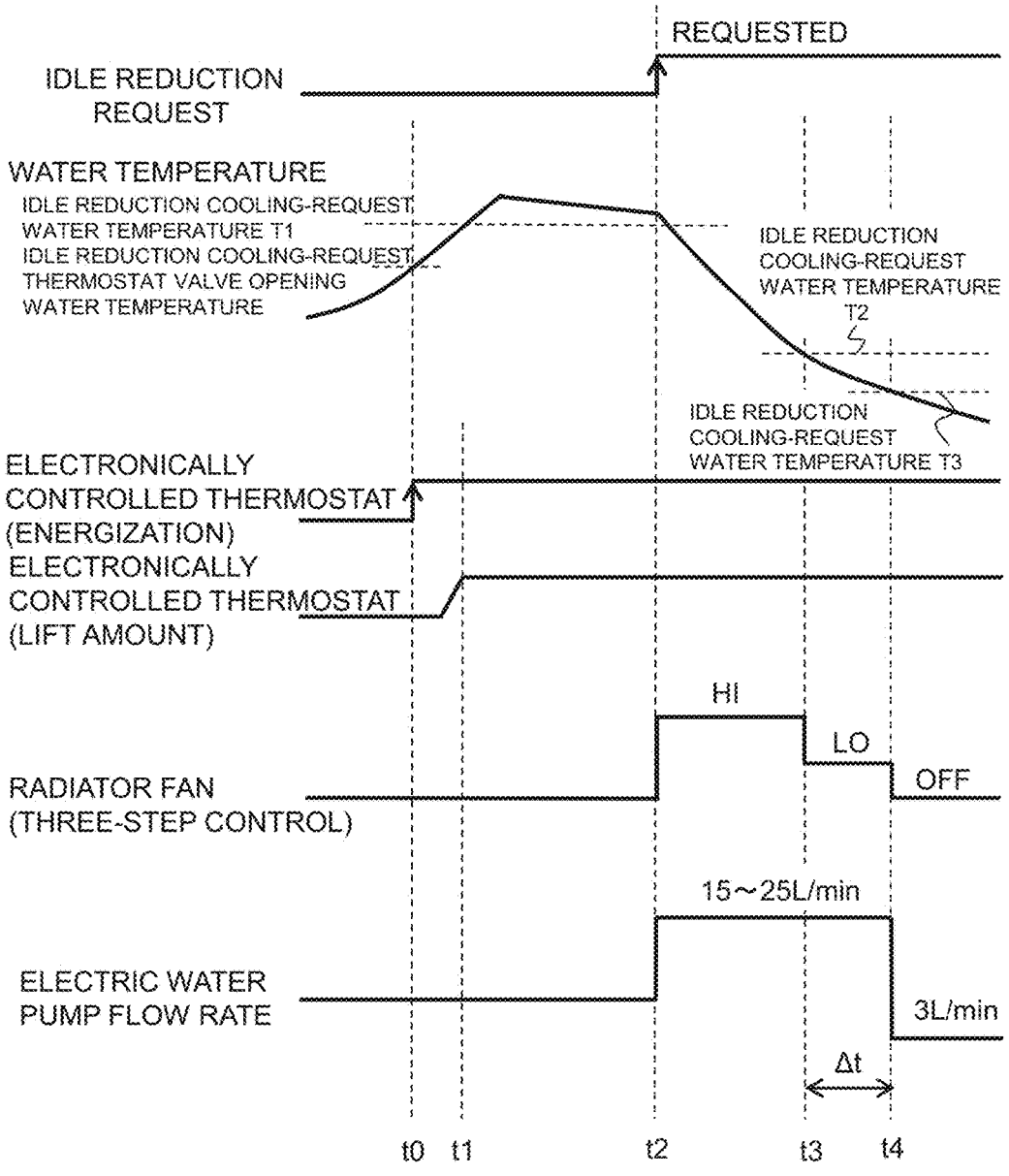
FIG. 6 is a flowchart for illustrating a third control operation of the water pump and the radiator fan at the idle reduction state by the cooling control apparatus in FIG. 1.

FIG. 6 illustrates a third control operation in which when the cooling control apparatus includes an electronically controlled thermostat, if a cooling request is made, an electric current is applied to wax so as to decrease a thermostat valve opening water temperature (control water temperature). When the water temperature reaches the idle reduction cooling request thermostat valve opening water temperature (time t0), the electronically controlled thermostat is energized under control of electronic control device 100, and subsequently the lift amount of the electronically controlled thermostat increases (time t1). As a result, the thermostat valve opening water temperature decreases. If the idle reduction request is made at time t2, since the water temperature is higher than idle reduction cooling request water temperature T1, electronic control device 100 causes radiator fan 53 to be driven at high speed, and causes water pump 40 to be drive to discharge cooling water at a flow rate of 15 to 25 L/min.

At time t3, when the water temperature decreases to less than idle reduction cooling request water temperature T2, radiator fan 53 is switched to a low speed drive. At time t4, when the water temperature decreases to less than idle reduction cooling request water temperature T3, radiator fan 53 is stopped (OFF) and water pump 40 is switched to a drive for discharging cooling water at a flow rate of 3 L/min. According to the third control operation above, the valve opening water temperature for the electronically controlled thermostat is controlled as well as water pump 40 and radiator fan 53, whereby more reduction in power consumption can be achieved while improving cooling effect than the first and second control operations.

Figure 7A:
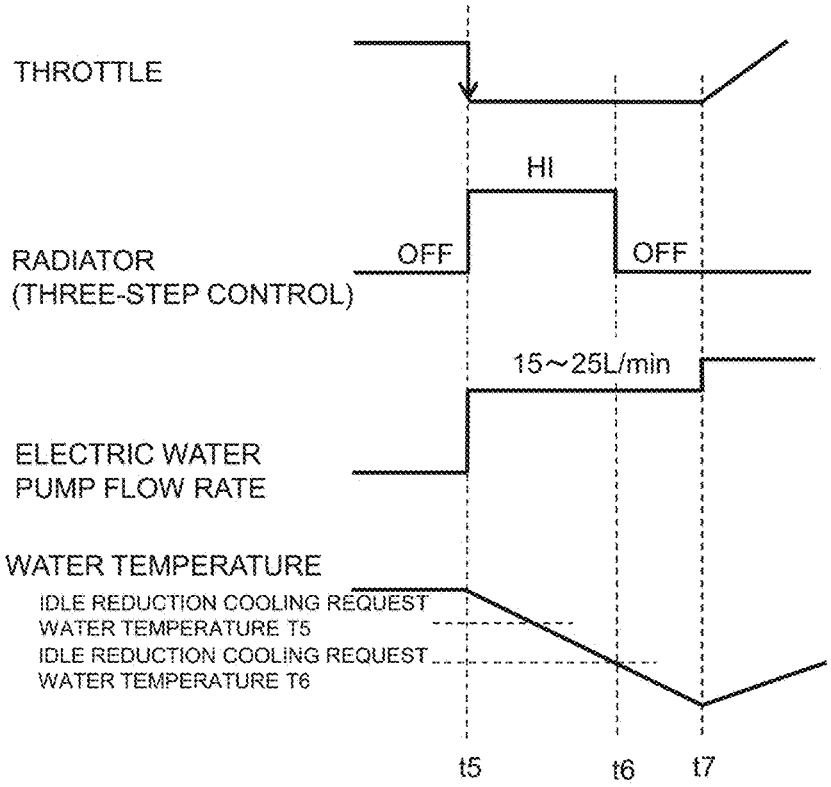
FIG. 7A is a timing chart of respective signals in a modification of the first control operation in FIG. 2.
Figure 7B:
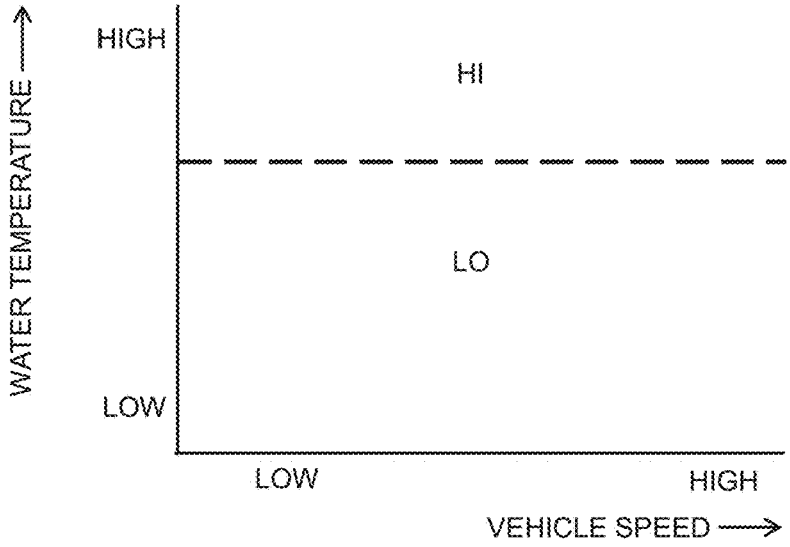
FIG. 7B is a characteristic diagram illustrating the relationship between the vehicle speed and the water temperature in the modification of the first control operation in FIG. 2.

FIG. 7A illustrates a modification of the first control operation in FIG. 2. According to a present modification 1, in addition to driving control of water pump 40 and radiator fan 53 at the idle reduction state as in the first control operation, pre-cooling is performed for re-acceleration after the idle reduction state. When the throttle is closed at time t5, if the water temperature is higher than idle reduction cooling request water temperature T5, radiator fan 53 is driven at high speed, and water pump 40 is driven to discharge the cooling water at a flow rate of 15 to 25 L/min. Control at this time of radiator fan 53 is determined according to the water temperature and the vehicle speed. For example, as shown by broken lines in FIG. 7B, if the water temperature is higher than a predetermined value, the radiator fan is driven at high rpm, whereas if the water temperature is lower than the predetermined value, the radiator fan is driven at low rpm.

At time t6, when the water temperature decreases to less than idle reduction cooling request water temperature T6 (T6<T5), radiator fan 53 is switched to a low speed drive. At time t7, when the throttle opens, the flow rate of water pump 40 is increased and the water temperature starts increasing. According to the control method as described above, pre-cooling is performed for re-acceleration after the idle reduction state, whereby power consumption can be reduced while improving cooling effect. In other words, when radiator fan 53 stops during traveling of the vehicle before the idle reduction state, by starting operation of radiator fan before the vehicle is decelerated and stopped, a cooling period after the idle reduction state can be reduced and pre-ignition at an early automatic start-up can be suppressed. Furthermore, the operating period of the radiator fan during the idle reduction state can be reduced, and quiet performance can be enhanced.

Figure 8A:
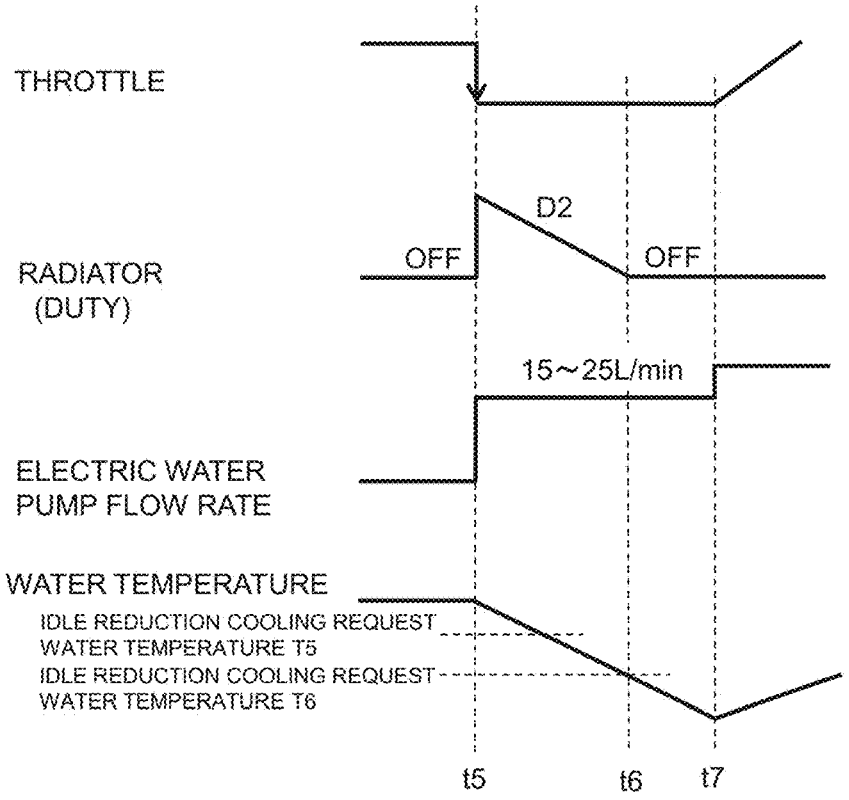
FIG. 8A is a timing chart of respective signals in a modification of the second control operation in FIG. 4.
Figure 8B:
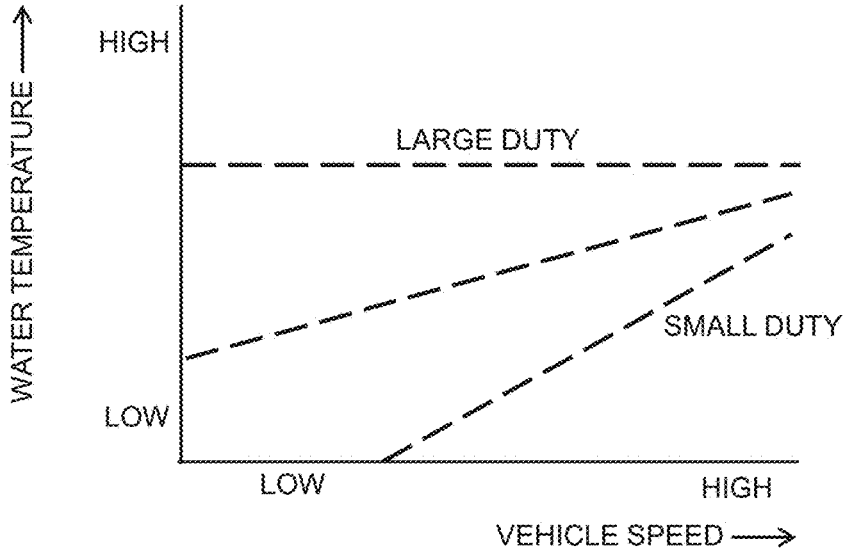
FIG. 8B is a characteristic diagram illustrating the relationship between the vehicle speed and the water temperature in the modification of the second control operation in FIG. 4.

FIG. 8A illustrates a modification of the second control operation in FIG. 4. According to a present modification 2, in addition to driving control of water pump 40 and radiator fan 53 at the idle reduction state as in the second control operation, pre-cooling is performed for re-acceleration after the idle reduction state. When the throttle is closed at time t5, if the water temperature is higher than idle reduction cooling request water temperature T5, radiator fan 53 is driven at duty D2, and water pump 40 is driven to discharge the cooling water at a flow rate of 15 to 25 L/min. Control at this time of radiator fan 53 is determined according to the water temperature and the vehicle speed. For example, as shown by broken lines in FIG. 8B, if the duty is large (LARGE DUTY), the control is determined according to the water temperature irrespective of the vehicle speed, and if the duty is small (SMALL DUTY), the water temperature increases with an increase of vehicle speed.

At time t6, when the water temperature decreases to less than idle reduction cooling request water temperature T6 (T6<T5), radiator fan 53 is switched to a drive at duty D1. At time t7, when the throttle opens, the flow rate of water pump 40 is increased and the water temperature starts increasing. According to the control method as described above, pre-cooling is performed for re-acceleration after the idle reduction state, whereby power consumption can be reduced while improving cooling effect.

Figure 9:
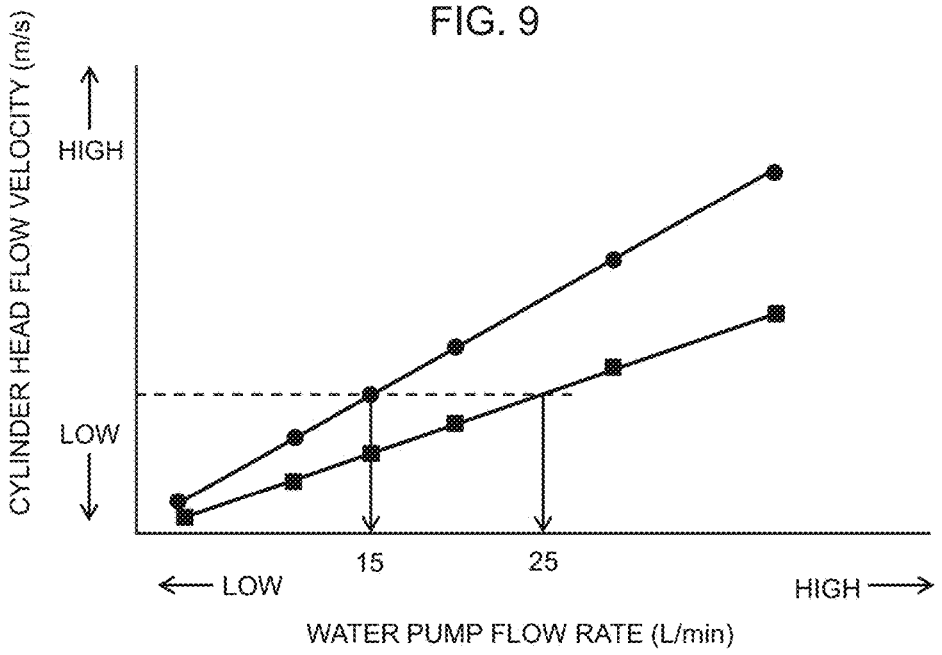
FIG. 9 is a characteristic diagram illustrating the relationship between the flow rate of the water pump and the flow velocity in the cylinder head.

FIG. 9 illustrates the relationship between the flow rate of the water pump and the flow velocity in the cylinder head. It is known that the flow rate is fundamentally in a linear relationship with the flow velocity, and heat radiation effect decreases even if the flow rate is increased. Specifically, it is said that the heat radiation effects decreases when the flow rate is higher than or equal to 0.7 m/sec. In light of the above, according to the embodiment described above, a water pump flow rate (15 to 25 L/min) when a flow velocity is 0.7 m/sec flow velocity as shown by dashed line was experimentally determined, and the flow rate of water pump 40 at the idle reduction state is set thereto.

Figure 10:
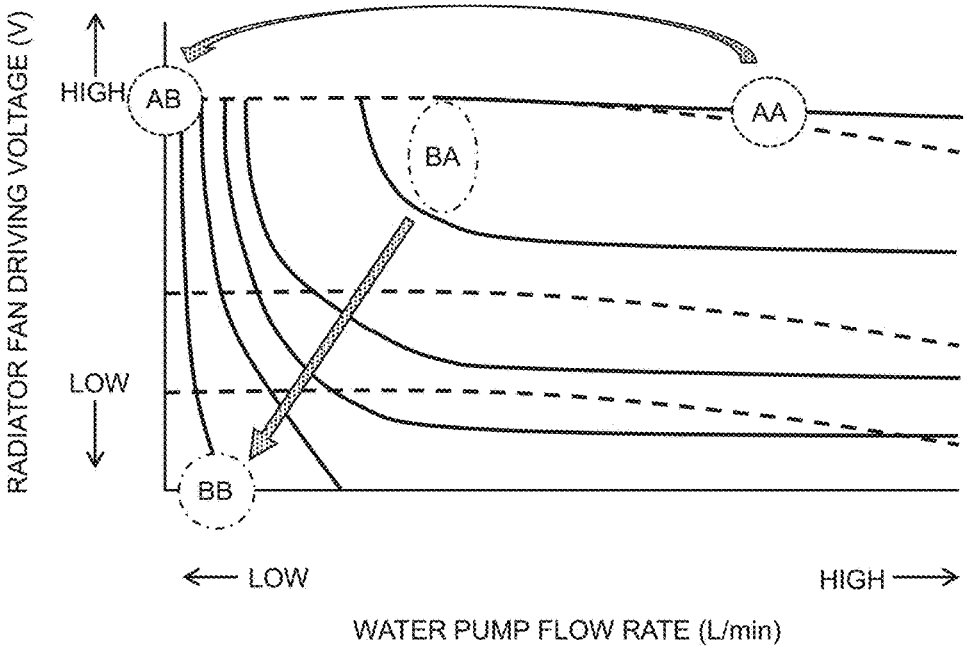
FIG. 10 is a characteristic diagram for explaining the relationship between the flow rate of the water pump and the drive voltage of the radiator fan.

FIG. 10 illustrates the relationship between the flow rate of the water pump of the invention and the drive voltage of the radiator fan, in which solid lines represent water temperature changes for different initial temperatures after a lapse of 60 seconds from the idle reduction state. Furthermore, a dashed line represents change in the sum of the power consumption of radiator fan 53 and the power consumption of water pump 40. As shown in area AA surrounded by a dashed line, even if the flow rate of water pump 40 is increased, cooling effect is not much changed and merely the power consumption increases. As shown in area AB, if water pump 40 is stopped after reduction of water temperature, reduction in power consumption is small.

Figure 11:
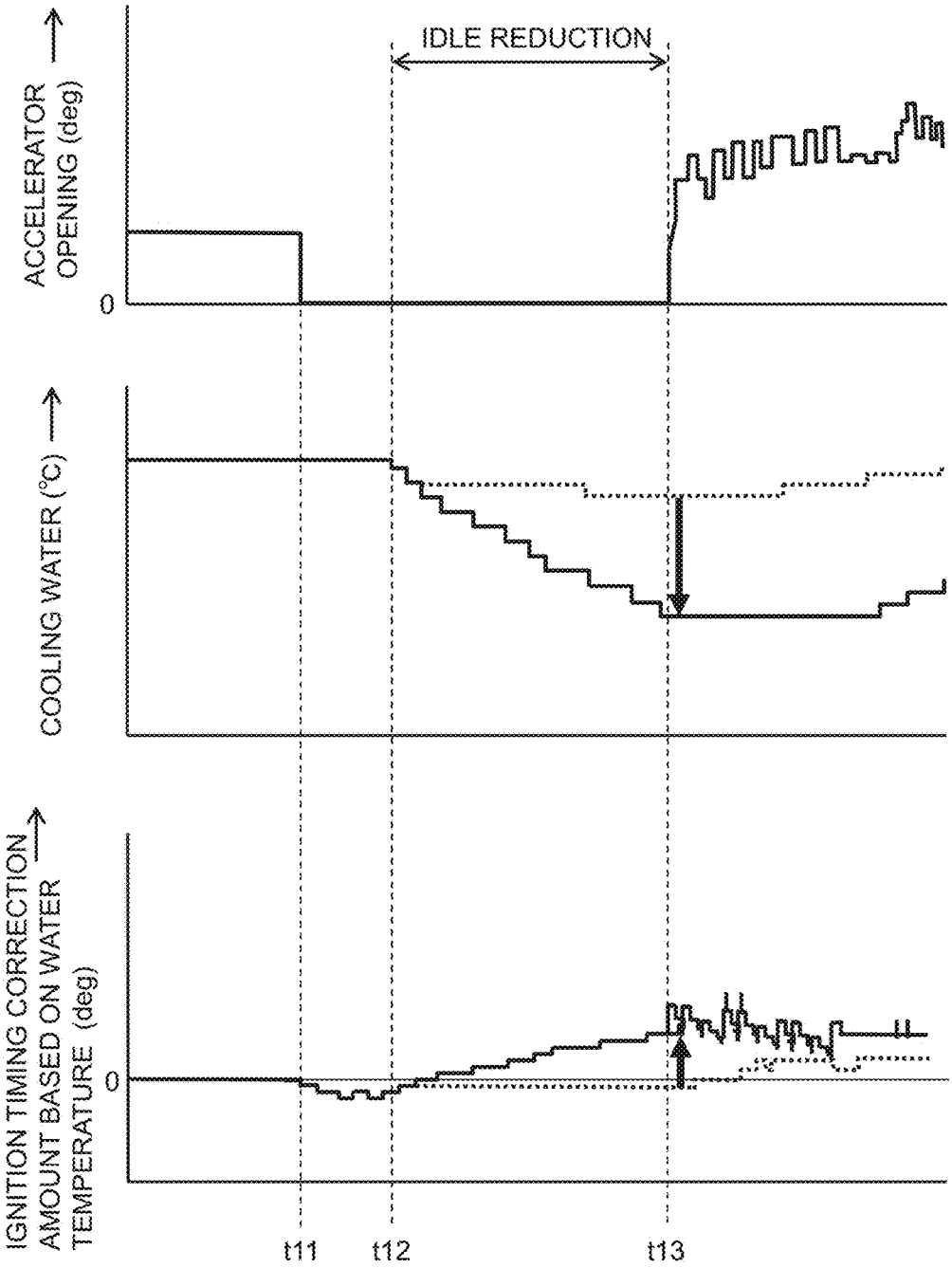
FIG. 11 is a timing chart for explaining a conventional cooling effect and a cooling effect of the present invention.

In contrast, according to the present invention, to achieve improvement of cooling effect and reduction of power consumption, the flow rate of water pump 40 is set as shown by area BA surrounded by an alternating long-and-short dashed line, and subsequently the radiator fan is stopped, so that the flow rate of water pump 40 is decreased as shown by area BA and a drive voltage of radiator fan 53 is decreased, whereby power consumption is reduced. Furthermore, as shown in the timing chart of FIG. 11, cooling during the idle reduction state allows the ignition timing to be advanced. From this point of view as well, fuel economy can be improved. For example, assume that an accelerator is closed at time t11, the idle reduction state is maintained between time t12 and time t13, and the accelerator is operated from time t13.

Changes of cooling water temperature are: when not cooled, the temperature is maintained at high as shown in dashed line, whereas when cooled by radiator fan 53 and water pump 40, it decreases as shown by solid line. Thus, a correction to advance the ignition timing is performed, whereby the torque increases and the fuel economy also enhances.

In the embodiment described above, an example in which the temperature of cylinder head 11 and the temperature of cylinder block 12 are controlled to their respective target temperatures. However, the present invention is not limited to such system configuration. The present invention is applicable to any cooling control apparatus for an internal combustion engine including an electric pump for circulating a coolant through a coolant passage formed in the internal combustion engine, and a radiator and a radiator fan that are for cooling the coolant.

The description above has been given taking as an example the case in which the temperature of the cooling water is measured near the outlet of cylinder head 11 by first water temperature sensor 81 and near the outlet of cylinder block 12 by second water temperature sensor 82. However, these water temperature sensors may be disposed any other positions as long as the temperature of the cooling water can be measured. Furthermore, the description has been given taking as an example a cooling apparatus including flow control valve 30 that is operated by an electric actuator. However, the present invention is applicable to any other structures as long as they are of the water cooling type cooling apparatus.

REFERENCE SYMBOL LIST

10 engine (internal combustion engine)
20 transmission
30 flow control valve
40 water pump (electric pump)
50 radiator
53 radiator fan
60 cooling water passage (coolant passage)
81, 82 temperature sensor (water temperature sensor)
100 electronic control device

The invention claimed is:

1. A cooling control apparatus for an internal combustion engine, comprising:

an electric pump for circulating a coolant through a coolant passage formed in the internal combustion engine; and a radiator and a radiator fan which are for cooling the coolant, wherein after completion of warming-up the internal combustion engine, when an automatic stop request is made for automatically stopping operation of the internal combustion engine with decrease in speed of a vehicle, if a temperature of the coolant is higher than or equal to a first cooling request temperature at the automatic stop, the radiator fan is driven at high speed, and the coolant is discharged for cooling from the electric pump at a first predetermined flow rate that is requested at the automatic stop of the internal combustion engine, when the temperature of the coolant decreases to a second cooling request temperature that is less than the first cooling request temperature, the radiator fan is switched to a low-speed drive, and when the temperature of the coolant decreases to a third cooling request temperature that is less than the second cooling request temperature and less than a temperature at the automatic stop, the radiator fan is stopped, and the coolant is discharged for cooling from the electric pump at a second predetermined flow rate which is less than a flow rate required for an automatic stop operation of the internal combustion engine.

2. The cooling control apparatus for an internal combustion engine according to claim 1, wherein when the radiator fan is stopped during traveling of the vehicle, operation of the radiator fan is started before the vehicle stops after deceleration.

3. The cooling control apparatus for an internal combustion engine according to claim 2, wherein during the automatic engine stop, the electric pump discharges a coolant at a third predetermined flow rate that is less than a discharge amount required for idling the internal combustion engine.

4. The cooling control apparatus for an internal combustion engine according to claim 1, wherein when the vehicle is decelerated, pre-cooling is performed for re-acceleration after the automatic stop operation.

5. The cooling control apparatus for an internal combustion engine according to claim 4, wherein the pre-cooling is performed as follows:

when a throttle is closed, if a temperature of the coolant is higher than a fourth cooling request temperature, the radiator fan is driven at high speed and the electric pump is driven to discharge cooling water at the first predetermined flow rate, when the temperature of the coolant decreases to a fifth cooling request temperature that is less than the fourth cooling request temperature, the radiator fan is switched to the low-speed drive, and when the throttle is opened, the flow rate of the electric pump is increased.

6. The cooling control apparatus for an internal combustion engine according to claim 5, wherein control of the radiator fan is determined according to a water temperature and a vehicle speed, and if the water temperature is higher than a predetermined value, the radiator fan is driven at high rpm, whereas if the water temperature is less than the predetermined value, the radiator fan is driven at low rpm.

7. The cooling control apparatus for an internal combustion engine according to claim 1, wherein a high speed drive of the radiator fan is to drive the radiator fan at a first duty, and the low speed drive of the radiator fan is to drive the radiator fan at a second duty less than the first duty.

8. The cooling control apparatus for an internal combustion engine according to claim 7, wherein when the vehicle is decelerated, pre-cooling is performed for re-acceleration after the automatic stop operation.

9. The cooling control apparatus for an internal combustion engine according to claim 8, wherein the pre-cooling is performed as follows:

when a throttle is closed, if a temperature of the coolant is higher than a fourth cooling request temperature, the radiator fan is driven at the second duty and the electric pump is driven to discharge cooling water at the first predetermined flow rate, when the temperature of the coolant decreases to a fifth cooling request temperature that is less than the fourth cooling request temperature, the radiator fan is stopped, and when the throttle is opened, the flow rate of the electric pump is increased.

10. The cooling control apparatus for an internal combustion engine according to claim 9, wherein the control of the radiator fan is determined according to a water temperature and a vehicle speed, and if the water temperature is higher than a predetermined value, the radiator fan is driven at high rpm, whereas if the water temperature is less than the predetermined value, the radiator fan is driven at low rpm.

11. The cooling control apparatus for an internal combustion engine according to claim 1, further comprising an electronically controlled thermostat, wherein when a cooling request is made in an automatic stopped state in which operation of the internal combustion engine is automatically stopped with decrease in speed of a vehicle in which the internal combustion engine is mounted, a control water temperature of the electronically controlled thermostat is decreased.

12. The cooling control apparatus for an internal combustion engine according to claim 11, wherein the control water temperature of the electronically controlled thermostat is for applying an electric current to wax so as to decrease a thermostat valve opening temperature.

13. The cooling control apparatus for an internal combustion engine according to claim 12, wherein the thermostat valve opening temperature of the electronically controlled thermostat is lower than a first cooling request temperature at the automatic stop, and is higher than a second cooling request temperature at which the radiator fan is switched to the low speed drive.

14. A cooling control method for an internal combustion engine including an electric pump for circulating a coolant through a coolant passage formed in the internal combustion engine, and a radiator and a radiator fan which are for cooling the coolant, the method comprising:

after completion of warming-up the internal combustion engine, when an automatic stop request is made for automatically stopping operation of the internal combustion engine with decrease in speed of a vehicle, if a temperature of the coolant is higher than or equal to a first cooling request temperature at the automatic stop, driving the radiator fan at high speed, and discharging the coolant for cooling from the electric pump at a first predetermined flow rate that is requested at the automatic stop of the internal combustion engine;

when the temperature of the coolant decreases to a second cooling request temperature that is less than the first cooling request temperature, switching the radiator fan to a low-speed drive; and when the temperature of the coolant decreases to a third cooling request temperature that is less than the second cooling request temperature and less than a temperature at the automatic stop, stopping the radiator fan, and discharging the coolant for cooling from the electric pump at a second predetermined flow rate which is less than a flow rate required for an automatic stop operation of the internal combustion engine.

15. The cooling control method for an internal combustion engine according to claim 14, wherein when the radiator fan is stopped during traveling of the vehicle, operation of the radiator fan is started before the vehicle stops after deceleration.

16. The cooling control method for an internal combustion engine according to claim 15, wherein during the automatic engine stop, the electric pump discharges the coolant at a third predetermined flow rate that is less than a discharge amount required for idling the internal combustion engine.

* * * * *